US009574534B2

(12) United States Patent
Zdroik

(10) Patent No.: US 9,574,534 B2
(45) Date of Patent: Feb. 21, 2017

(54) REINFORCED END CAP ASSEMBLY FOR PRESSURE VESSEL

(71) Applicant: MILLENNIUM INDUSTRIES CORPORATION, Ligonier, IN (US)

(72) Inventor: Michael J. Zdroik, Metamora, MI (US)

(73) Assignee: MILLENNIUM INDUSTRIES CORPORATION, Ligonier, IN (US)

( * ) Notice: Subject to any disclaimer, the term of this patent is extended or adjusted under 35 U.S.C. 154(b) by 76 days.

(21) Appl. No.: 14/716,035

(22) Filed: May 19, 2015

(65) Prior Publication Data

US 2016/0341167 A1 Nov. 24, 2016

(51) Int. Cl.

| | |
|---|---|
| ***F02M 55/00*** | (2006.01) |
| ***F02M 55/02*** | (2006.01) |
| ***F02M 63/02*** | (2006.01) |
| ***F02M 69/46*** | (2006.01) |

(52) U.S. Cl.

CPC ..... *F02M 55/025* (2013.01); *F02M 63/0275* (2013.01); *F02M 69/465* (2013.01); *F02M 2200/03* (2013.01); *F02M 2200/8084* (2013.01); *F02M 2547/005* (2013.01)

(58) Field of Classification Search

CPC ..... F02M 55/025; F02M 63/0225; F02M 63/0275; F02M 63/028; F02M 69/465; F02M 2200/8084; F02M 2200/03; F02M 2547/005; F02M 2700/05

USPC ..... 123/456, 468

See application file for complete search history.

(56) References Cited

U.S. PATENT DOCUMENTS

| | | | | |
|---|---|---|---|---|
| 4,519,368 | A | 5/1985 | Hudson, Jr. | |
| 4,552,311 | A | 11/1985 | Casey | |
| 5,027,777 | A | 7/1991 | De Bruyn et al. | |
| 5,783,078 | A | 7/1998 | Roll et al. | |
| 6,217,065 | B1 | 4/2001 | Al-Amin et al. | |
| 6,470,859 | B2 | 10/2002 | Imura et al. | |
| 6,659,371 | B2 | 12/2003 | Carney | |
| 6,874,477 | B1 | 4/2005 | Lorraine et al. | |
| 6,892,704 | B2 | 5/2005 | Tsuchiya et al. | |
| 6,959,695 | B2 | 11/2005 | Warner et al. | |
| 7,028,668 | B1 * | 4/2006 | West | F02M 55/025 123/456 |
| 7,263,975 | B2 * | 9/2007 | Stieler | B29C 65/3656 123/456 |
| 7,810,471 | B2 | 10/2010 | Zdroik | |
| 7,921,881 | B2 | 4/2011 | Zdroik et al. | |
| 8,327,829 | B2 | 12/2012 | Keidel et al. | |
| 8,458,904 | B2 | 6/2013 | Zdroik et al. | |
| 8,495,985 | B2 | 7/2013 | Harada et al. | |

(Continued)

*Primary Examiner* — Erick Solis

(74) *Attorney, Agent, or Firm* — Brinks Gilson & Lione

(57) ABSTRACT

A fuel rail or pressure vessel assembly extends along a longitudinal axis and includes a fluid conduit having an opening at either or both of the longitudinal ends of the conduit. The conduit has an inlet coupled to a high-pressure fuel source, a plurality of outlets, and a conduit interior that forms a fluid flow passageway between inlet and outlets. An end cap assembly is mounted to cover and close each fluid conduit opening. The end cap assembly includes a cup having a free edge that defines an aperture that leads to a cup interior. The cup has an inner surface facing the conduit interior. The end cap assembly also includes a reinforcement that is mounted to the inner surface of the cup. Both the cup and the reinforcement can be stamped metal components and are brazed together.

16 Claims, 9 Drawing Sheets

(56) References Cited

U.S. PATENT DOCUMENTS

| | | | | |
|---|---|---|---|---|
| 2004/0000291 | A1* | 1/2004 | Tsuchiya | F02M 55/025 123/456 |
| 2005/0133008 | A1* | 6/2005 | Zdroik | F02M 69/465 123/456 |
| 2006/0254563 | A1* | 11/2006 | Keegan | F02M 55/02 123/456 |
| 2008/0142105 | A1* | 6/2008 | Zdroik | F02M 55/025 138/30 |
| 2014/0007960 | A1* | 1/2014 | Niwa | F02M 55/02 137/561 A |
| 2014/0014068 | A1 | 1/2014 | Ramamurthy et al. | |
| 2014/0261330 | A1* | 9/2014 | Doherty | F02M 63/0275 123/456 |

* cited by examiner

REINFORCED END CAP ASSEMBLY FOR PRESSURE VESSEL

CROSS-REFERENCE TO RELATED APPLICATIONS

Not applicable.

BACKGROUND a. Technical Field

The instant disclosure relates generally to a fuel rail assembly and more specifically to an end cap assembly for the fuel rail assembly.

b. Background Art

This background description is set forth below for the purpose of providing context only. Therefore, any aspects of this background description, to the extent that it does not otherwise qualify as prior art, is neither expressly nor impliedly admitted as prior art against the instant disclosure.

It is known to provide a fuel delivery system for use with an internal combustion engine. Such a system may include one or more fluid conduits that allow for the delivery of pressurized fuel to multiple fuel injectors. The fluid conduit (i.e., a fuel rail assembly) may include an inlet that is connected to a fuel source, for example, in some systems, an output of a high-pressure fuel pump. The fluid conduit also typically includes a plurality of outlets that are configured for mating with a corresponding fuel injector. The fluid conduit can have an opening at one or both of its longitudinal ends, which openings are covered and closed by an end cap.

Some fuel systems employ fuel rail assemblies to deliver fuel at a relatively low pressure (e.g., 3.0 bar to less than 100 bar). In such low pressure systems, a stamped metal end cap is used to provide a relatively low cost fuel rail assembly. It is known to employ higher pressure fuel systems, for example, gasoline direction injection (GDI) systems, which uses fuel pressures of about 100 bar (10 Mpa) in circa 2005, currently operate in the 150-180 bar (Mpa) range, and are expected to operate in the 200-350 bar (20-35 Mpa) range by 2018 and beyond. However, the above-mentioned stamped metal end caps are not used in such higher pressure systems because of limitations in the stamping wall thickness. In other words, there is a practical limit in the maximum thickness of the metal stock that can be stamped into an end cap. This (limited) thickness end cap is not suitable for such higher pressures. And while a machined metal end cap can be used that has the needed wall thickness for the increased fuel pressures, the machined end cap is more expensive. In addition, the gap left by the tube counter-bore that is not filled by the cap creates a stress riser for fatigue failures.

The foregoing discussion is intended only to illustrate the present field and should not be taken as a disavowal of claim scope.

BRIEF SUMMARY

One advantage of an embodiment of an end cap assembly consistent with the present teachings involves a reduced cost for the end cap assembly that is suitable for high pressure applications, as compared to conventional configurations that use a machined end cap. A fuel rail assembly—in embodiments consistent with the claims—includes an end cap assembly having a cup (e.g., which may be stamped, cold formed, or machined) and a reinforcement (e.g., which may also be stamped, cold formed, or machined) that is directly mounted to the interior of the cup (e.g., using a brazing material). The additional piece (reinforcement) reinforces the end cap assembly where it encounters the largest stress, namely, at the exposed portion thereof that extends outside a fluid conduit/pressure vessel. In an embodiment, cost savings for the end cap assembly can be as much as 40% or more, compared to a machined end cap assembly.

In an embodiment, a fuel rail assembly is provided that comprises a fluid conduit and an end cap assembly. The fluid conduit may have a body portion extending along a first longitudinal axis and having an opening at one of a first longitudinal end and a second, opposing longitudinal end. The end cap assembly is mounted to the first end of the body portion and is configured to cover and close the fluid conduit opening. In an embodiment, the fluid conduit has an opening at both longitudinal ends, and the fuel rail assembly includes a pair of end cap assemblies to cover and close these openings.

The fluid conduit may further have an inlet configured to be coupled to a high-pressure fuel source such as a fuel pump. The fluid conduit may still further have at least one outlet and a fluid flow passageway between the inlet and the at least one outlet configured to allow for fluid to be communicated between the inlet and the at least one outlet. The fluid conduit may still further have an inside surface and an outside surface.

The end cap assembly includes a cup having a free edge that defines an aperture that leads to an interior of the cup. The cup has an inner surface facing the interior of the cup. The end cap assembly further includes a reinforcement mounted to the inner surface of the cup. In a further embodiment, both the cup and the reinforcement may be stamped metal components. In a still further embodiment, the reinforcement is mounted to the cup with a brazing material, and can be mounted to the inner surface of the cup so as to increase the wall thickness of an exposed area of the cup. In a yet further embodiment, a brazing process in which at least one other component in the fuel rail assembly is brazed (mounted) is also the same brazing process where the reinforcement is mounted to the cup. Variations in the reinforcement shape and mounting relationship between reinforcement and cup are also presented.

In an embodiment, the reinforcement piece could also be used on an inlet to handle a gap left by a counter-bore there as well.

The foregoing and other aspects, features, details, utilities, and advantages of the present disclosure will be apparent from reading the following description and claims, and from reviewing the accompanying drawings.

DETAILED DESCRIPTION

Figure 1:
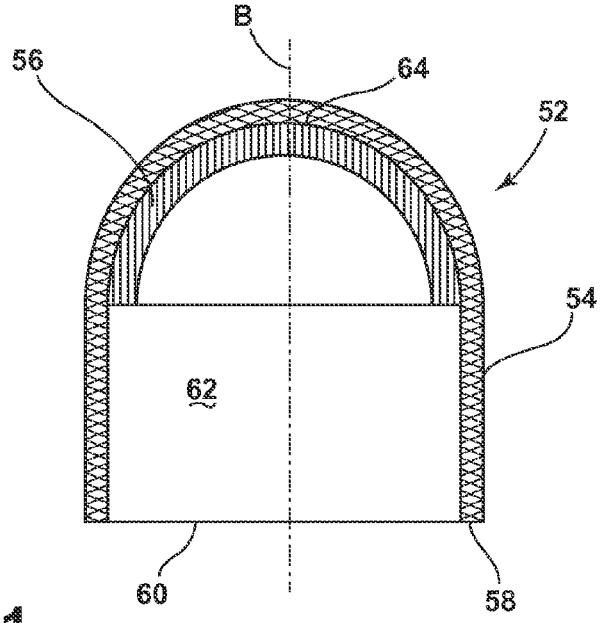
FIG. 1 is a simplified cross-sectional view of a first embodiment of an end cap assembly.
Figure 2:
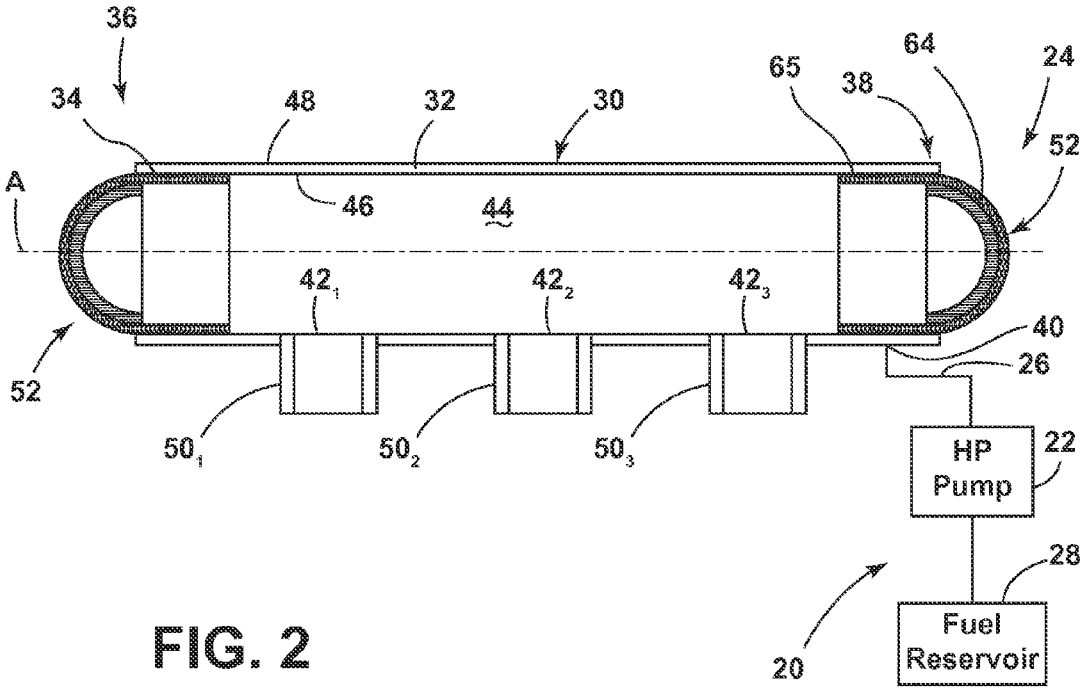
FIG. 2 is a cross-sectional view of a fuel rail assembly taken substantially along a longitudinal axis of a fluid conduit and which uses the end cap assembly of FIG. 1.

Referring now to Figures wherein like reference numerals identify identical or similar components in the various views, FIG. 1 is a simplified cross-sectional view of a first end cap assembly in accordance with a first embodiment of the instant disclosure, while FIG. 2 is a cross-sectional view of a fuel rail assembly that employs the end cap assembly shown in FIG. 1. As shown, the cross-section of the fuel rail assembly of FIG. 2 is taken substantially along the longitudinal axis of the fluid conduit. The fluid (e.g., fuel) delivery system and the components and methods of assembling the same to be described herein may have application with respect to a spark-ignited, fuel-injected internal combustion engine; however, other applications are contemplated, as will be recognized by one of ordinary skill in the art.

With continued reference to FIGS. 1 and 2, a fuel delivery system 20 includes a high-pressure fuel source such as a fuel pump 22, a fuel rail assembly 24, and a supply hose or conduit 26 fluidly coupling the pump 22 to the fuel rail assembly 24. A fuel reservoir or tank 28 is also shown coupled to the pump 22. The fuel delivery system 20 may be configured for use with a multiple-cylinder internal combustion engine, as known. The high-pressure fuel pump 22 may comprise conventional components known in the art. The outlet of the high-pressure fuel pump 22 is coupled through the supply hose 26 to the fuel rail assembly 24 and may be attached at each end using conventional fluid attachment means. Embodiments described herein may have particular application to relatively high pressure fuel delivery applications, such as gasoline direct injection (GDI) applications. GDI applications can involve fuel pressures of 150-180 bar (15-18 Mpa) and are contemplated to reach higher pressures (e.g., 200-350 bar/20-35 Mpa) in the future.

The fuel rail assembly 24 includes a fluid conduit 30 extending along a first longitudinal axis "A" and having a body portion 32 (i.e., also sometimes referred to as outer wall 32). The fluid conduit 30 includes at least one opening 34 at one of a first longitudinal end 36 and a second longitudinal end 38. Note that the second longitudinal end 38 is axially opposite of the first longitudinal end 36. Also, in the illustrated embodiment, the fluid conduit 30 includes a respective opening 34 at each of the longitudinal ends 36, 38.

The fluid conduit 30 has an inlet 40 configured to be coupled to the output of a high pressure fuel source such as the high-pressure fuel pump 22. The fluid conduit 30 further includes at least one outlet 42 (viz. three are shown, designated as $\mathbf{42}_1$, $\mathbf{42}_2$, and $\mathbf{42}_3$). The fluid conduit 30 also includes an interior portion 44 defined by the conduit outer wall 32 that functions as a fluid flow passageway for fluid communication between the inlet 40 and one or more of the outlets 42.

The fluid conduit 30 may comprise a tube or pipe or other shape/configuration that can function as a pressure vessel, as known in the art. The fluid conduit 30 and components thereof (including the end cap assembly described herein) may be formed of numerous types of materials, such as, for exemplary purposes only, aluminum, various grades of stainless steel, low carbon steel, other metals, and/or various types of plastics. In an embodiment, the fuel rail assembly 24 (and components thereof) may be formed of a metal or other materials that can be brazed, and thus can withstand furnace brazing temperatures on the order of 2050° F. (1121° C.). The fuel rail assembly 24 (and components thereof) may further have different thicknesses in various portions. Additionally, although the fuel rail assembly 24, specifically the fluid conduit portion 30, may have a generally circular cross-sectional shape in the illustrated embodiment, it should be understood that it may alternatively have any number of different cross-sectional shapes. In the illustrated embodiment, the fluid conduit 30 comprises a circular (round) shaped pipe where the outer wall 32 includes an inside surface 46 and an outside surface 48.

Each of the outlets $\mathbf{42}_1$, $\mathbf{42}_2$, and $\mathbf{42}_3$ may be disposed in proximity to a respective fuel injector cup 50 (viz. three are shown and are designated $\mathbf{50}_1$, $\mathbf{50}_2$, and $\mathbf{50}_3$), so as to allow transfer of pressurized fuel to a corresponding plurality of fuel injectors (not shown) that are connected to the fuel injector cups 50. The injectors (not shown) may be of the electrically-controlled type, and therefore each may include a respective electrical connector (not shown) configured for connection to an electronic engine controller or the like (not shown).

In addition, the fuel rail assembly 24 may include a plurality of mounting bosses or brackets (best shown in FIGS. 3, 6, 9, and 12 as mounting bosses $\mathbf{51}_1$, $\mathbf{51}_2$, $\mathbf{51}_3$, and $\mathbf{51}_4$). The mounting bosses $\mathbf{51}_1$, $\mathbf{51}_2$, $\mathbf{51}_3$, and $\mathbf{51}_4$ can be used in combination with corresponding fasteners or the like to secure the fuel rail assembly 24 within an engine compartment.

The fuel rail assembly 24 further includes one or more end cap assemblies 52 mounted to the one or the other (or both) of the first and second longitudinal ends 36, 38. The end cap assemblies 52 are configured to cover and close the respective openings 34 at each end of the fluid conduit 30, thus fluidly sealing the ends of the fuel rail assembly 24.

The end cap assembly 52 extends along a second longitudinal axis designated "B" and includes a cup 54 and a reinforcement member 56 (hereinafter reinforcement 56). In an embodiment, both the cup 54 and the reinforcement 56 may both comprise a stamped metal component, in contrast to a machined metal part as described in the Background. It should be understood, however, that other manufacturing processes similar in simplicity and/or reduced cost as compared to stamping can be used as well. For example, cold forming, cold heading, forging, and potentially machining in some circumstances as well. In an embodiment, a fluid conduit wall thickness may be between about 1.5-6 mm. In an embodiment, the cup may have a wall thickness between about 1-4 mm while the reinforcement may have a wall thickness between about 1-4 mm as well.

The cup 54 provides, generally, a closure and sealing function and includes a free edge 58 that defines an aperture 60 that leads to an interior space or volume 62 of the cup 54.

The cup 54 has an inner surface 64 that faces the interior 62. The cup 54, in the illustrated embodiment, is substantially U-shaped.

As described in the Background, conventional stamped metal end caps do not possess the needed wall thickness to be used in higher pressure fuel rail assemblies. In other words, metal stock having a wall thickness suitable for stamping (or other similar manufacturing processes) will generally not possess the wall thickness adequate for higher pressure systems post-stamping. End cap assembly embodiments consistent with the instant teachings, however, overcome the problems known in the art. Specifically, an end cap assembly according to the instant teachings (i) possesses the effective wall thicknesses sufficient for use in higher pressure fuel rail assemblies, such as systems operating a higher that 200 bar, while (ii) obtaining the benefits of a simpler and reduced cost manufacturing approach, such as stamping or the like.

According to the instant teachings, in the illustrated embodiment, the reinforcement 56 (e.g., stamped component) is mounted to the inner surface 64 of the cup 54 (e.g., also a stamped component) using a brazing material by way of a brazing process. Additionally, the outer surface 65 of the cup 54 is likewise braze mounted to the inside surface 46 of the outer wall 32. Both brazed connections may be formed during the same brazing process.

In regard to the brazing process, the brazing material may be characterized as having a melting point such that it will change from a solid to a liquid when exposed to the level of heat being applied during the brazing operation (e.g., on the order of 2050° F. (1121° C.)), and which will then return to a solid once cooled. Examples of materials that can be used include, without limitation, and for exemplary purposes only, pre-formed copper pieces, copper paste, various blends of copper and nickel and various blends of silver and nickel, all of which have melting points on the order of approximately 1200-2050° F. (650-1121° C.). As the heating and cooling steps of the brazing operation are performed, the brazing material melts and is pulled into the joint(s)/contact surfaces as described herein. Once sufficiently cooled, the brazing material returns to a solid state, to thereby fix together the components of the sub-assembly being joined.

The resulting end cap assembly 52, as shown in FIG. 1, includes a double wall thickness in the area of highest stress in the fuel rail assembly 24, namely in the area of the cup 54 that is externally exposed (i.e., that part of the cup that is not covered up by the outer wall 32 of the fluid conduit 30). The increased, effective wall thickness of the end cap assembly 52 allow it to be used in high pressure applications (e.g., >200 bar), such as GDI applications. Moreover, the end cap assembly 52 does not carry with it the increased manufacturing cost due to complex and/or time consuming manufacturing processes, such as the increased cost associated with a machined end cap.

Figure 3:
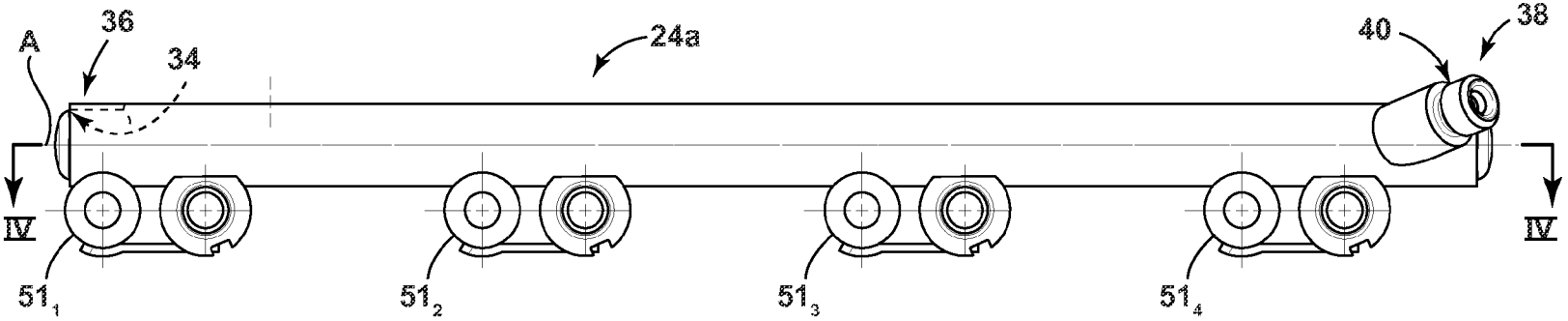
FIG. 3 is a side plan view of a fuel rail assembly including a second embodiment of an end cap assembly.
Figure 4:
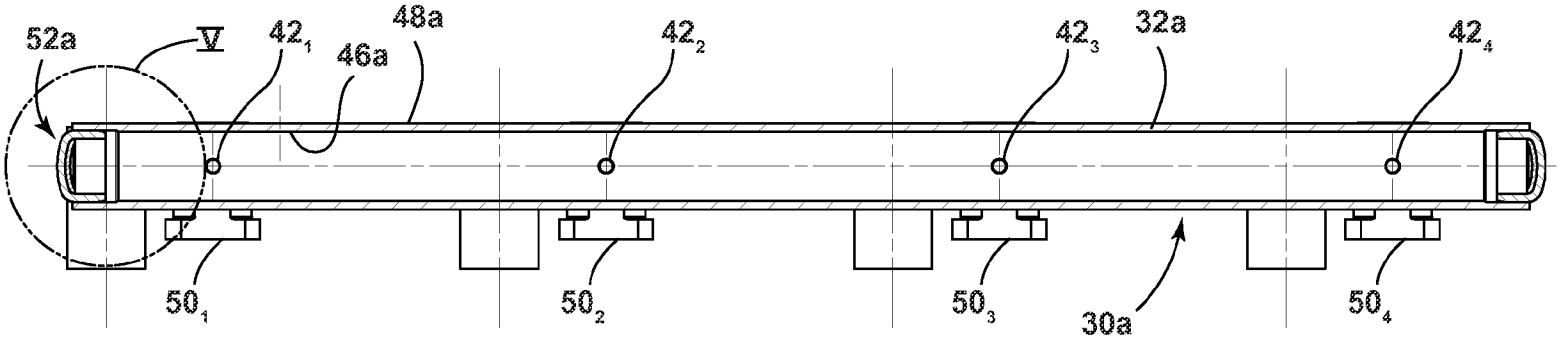
FIG. 4 is a cross-sectional view of the fuel rail assembly of FIG. 3 taken substantially along lines 4-4.
Figure 5:
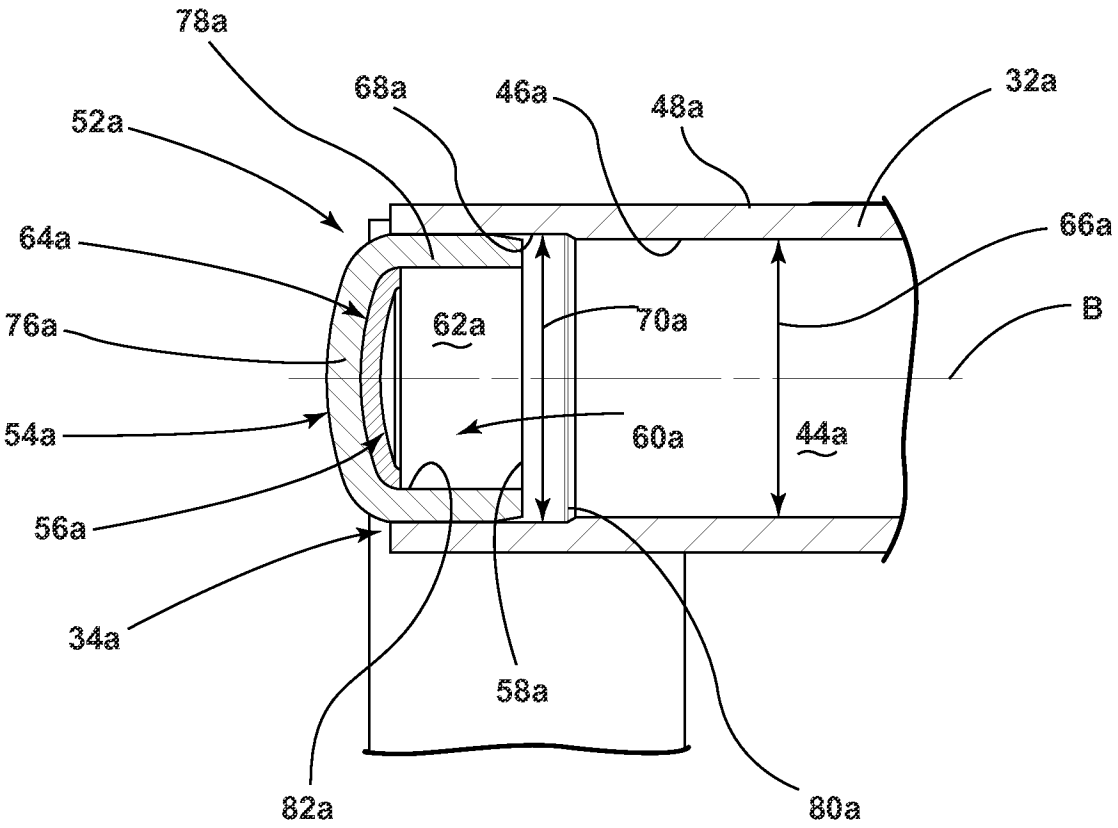
FIG. 5 is an enlarged, cross-sectional view of the end cap assembly of FIG. 4.

FIGS. 3-5 illustrate a fuel rail assembly 24*a* that uses a second embodiment of an end cap assembly, designated end cap assembly 52*a*. Features and/or components of this embodiment that are similar to corresponding features and/or components in the previously-described embodiment append an "a" suffix to the pertinent reference numeral. Additionally, the description of the fuel rail assembly 24 and the end cap assembly 52 made above applies generally to the fuel rail assembly 24*a* and the end cap assembly 52*a*, with the following additional description(s).

Referring now to FIG. 5, the end cap assembly 52*a* includes a cup 54*a* and a reinforcement 56*a*. The cup 54*a* includes a base 76*a* and an annular sidewall 78*a* axially extending away from the base 76*a*. The annular sidewall 78*a* has a free edge 58*a* that defines an aperture 60*a* that leads to an interior 62*a* of the cup 54*a*. The cup 54*a* has inner surfaces 64*a* (corresponding to the base) and 82*a* (corresponding to the annular sidewall) that face the interior 62*a*. In this embodiment, the reinforcement 56*a* is positioned on the portion of the cup 54*a* (i.e., the inside surface 64*a* associated with the base 76*a*) which is exposed to the outside, external environment and is thus not normally doubled up by the conduit wall thickness (outer wall 32*a*). Thus, the reinforcement 56*a* doubles up the wall thickness on the base 76*a*—a portion that would not be aligned with any part of the outer wall of the fluid conduit 30*a*. Additionally, the annular sidewall 78*a* of the cup and the thickness of the outer wall 32*a* also overlap over some axial length, effectively providing—over that axial length—twice the wall thickness as well.

With continued reference to FIG. 5, the outer wall 32*a* has an inside surface 46*a* and an outside surface 48*a*. The inside surface 46*a* in turn includes a first inside diameter portion 66*a* and a second inside diameter portion 70*a*. The second inside diameter portion 70*a* is located proximate to the at least one end opening 34*a* and has an inside surface 68*a*. As shown, the first inside diameter portion 66*a* is smaller in diameter than the second inside diameter portion 70*a*, which, in effect, forms a counter-bore 70*a*. In an embodiment, the counter-bore 70*a* can be machined to provide a controlled diameter for receiving the end cap assembly 52*c*.

As also shown, the first inside diameter portion 66*a* is relatively distal from both the end opening 34*a* and the counter-bore 70*a*. The free edge 58*a* of the cup 54*a* is located proximate to or near a transition 80*a* formed between the first diameter portion 66*a* and the second diameter portion 70*a*. The end cap assembly 52*a* is disposed in the opening 34*a* such that the interior 62*a* of the cup 52*a* faces the interior 44*a* of the fluid conduit 30*a*.

In some embodiments, the transition 80*a* can function as a mechanical stop when the end cap assembly 52*a* is inserted into the opening 34*a*. The outer diameter of the cup 54*a* is configured in size such that it can be introduced through the end opening 34*a*, with insertion continuing until the free edge 58*a* engages the transition 80*a*, thereby inhibiting further insertion.

The inner surface(s) of the cup 54*a* includes a first portion 64*a* corresponding to the base 76*a* and a second portion 82*a* corresponding to the annular sidewall 78*a*. In the illustrated embodiment, the reinforcement 56*a* is mounted (e.g., using a brazing material introduced by way of a brazing process) to the first portion 64*a* of the inner surface but does not extend over nor is not mounted to the second portion 82*a* of the inner surface of the cup 54*a*. As mentioned above, the sizing and placement reinforces the exposed portion of the cup, effectively doubling its wall thickness.

Figure 6:
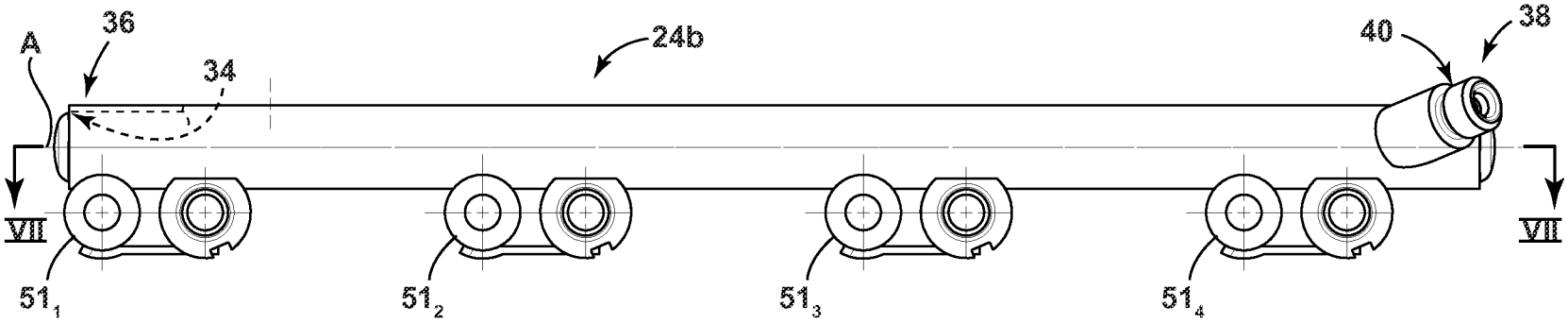
FIG. 6 is a side plan view of a fuel rail assembly including a third embodiment of an end cap assembly.
Figure 7:
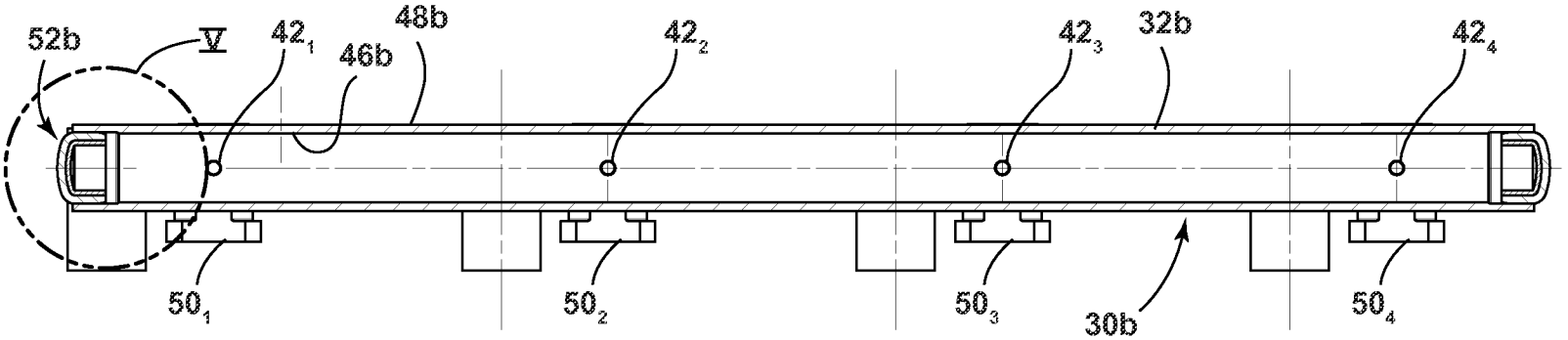
FIG. 7 is a cross-sectional view of the fuel rail assembly of FIG. 6 taken substantially along lines 7-7.
Figure 8:
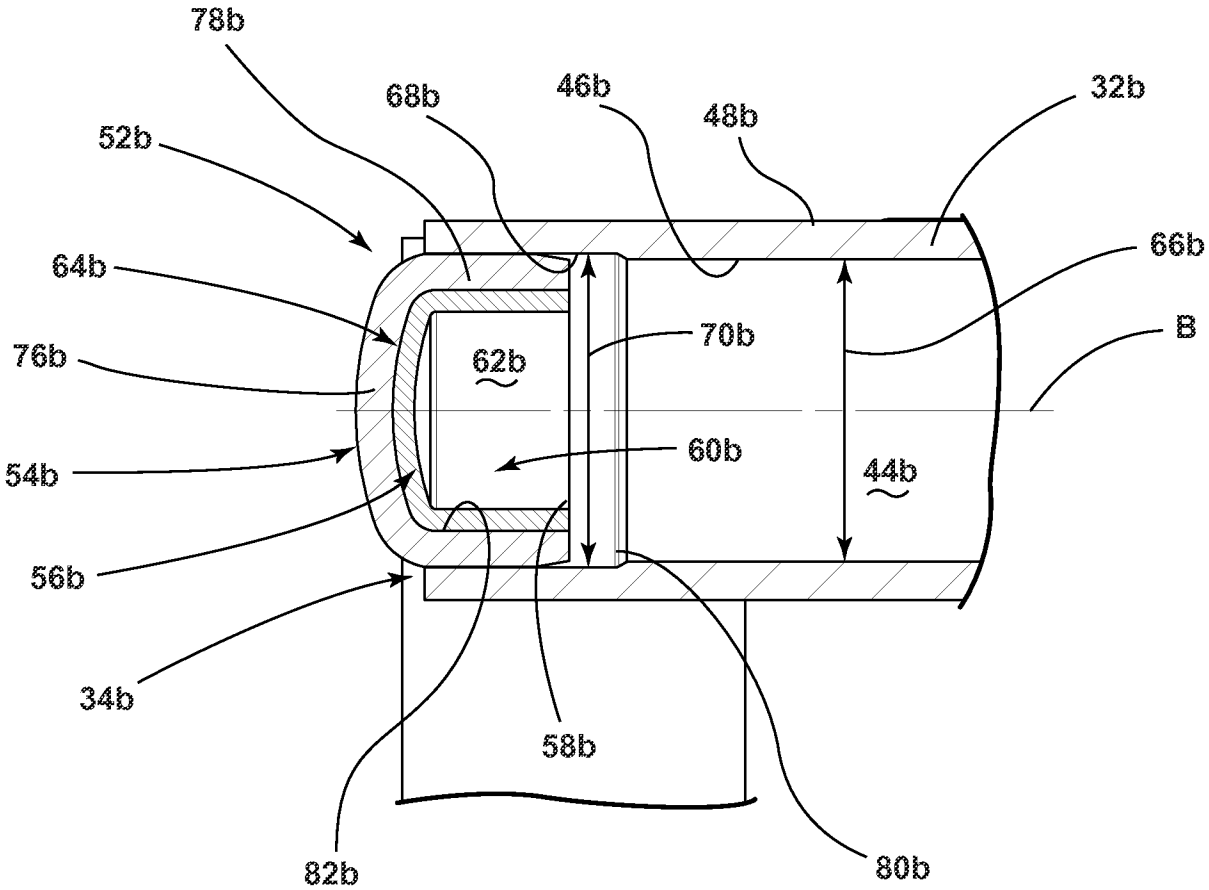
FIG. 8 is an enlarged cross-sectional view of the end cap assembly of FIG. 7.

FIGS. 6-8 illustrate a fuel rail assembly 24*b* that includes a third embodiment of an end cap assembly, designated end cap assembly 52*b*. Features and/or components in this embodiments that are similar to the corresponding features and/or components in the previously-described embodiments append a "b" suffix to the pertinent reference numeral. Additionally, the description of the fuel rail assemblies 24, 24*a* and the end cap assemblies 52, 52*a* made above applies generally to the fuel rail assembly 24*b* and the end cap assembly 52*b*, with the following additional description(s).

Referring now to FIG. 8, the end cap assembly 52*b* includes a cup 54*b* and an annular reinforcement 56*b*. The cup 54*b* is generally annular and includes a base 76*b* and an annular sidewall 78*b* axially extending away from the base 76*b*. The annular sidewall 78*b* has a free edge 58*b* that defines an aperture 60*b* that leads to an interior 62*b* of the cup 54*b*. The cup 54*b* has inner surfaces 64*b*, 82*b* that face the interior 62*b*. In this embodiment, the reinforcement 56*b* effectively doubles the wall thickness of the entire cup 54*b*.

The outer wall 32*b* has an inside surface 46*b* and an outside surface 48*b*. The inside surface 46*b* in turn includes a first inside diameter portion 66*b* and a second inside diameter portion 70*b*. The second inside diameter portion 70*b* is located proximate to the at least one opening 34*b* and has an inside surface 68*b*. As shown, the first inside diameter portion 66*b* is smaller in diameter than the second inside diameter portion 70*b*, which, in effect, forms a counter-bore 70*b*. In an embodiment, the counter-bore 70*b* can machined to provide a controlled diameter for receiving the end cap assembly 52*b*.

As also shown, the first inside diameter portion 66*b* is relatively distal from both the opening 34*b* and the counter-bore 70*b*. The free edge 58*b* of the cup 54*b* is located proximate to or near a transition 80*b* formed between the first diameter portion 66*b* and the second diameter portion 70*b*. The end cap assembly 52*b* is disposed in the opening 34*b* such that the interior 62*b* of the cup 52*b* faces the interior 44*b* of the fluid conduit 30*b*.

In some embodiments, the transition 80*b* can function as a mechanical stop when the end cap assembly 52*b* is inserted into the opening 34*b*. The outer diameter of the cup 54*b* is configured in size such that it can be introduced through the end opening 34*b*, with insertion continuing until the free edge 58*b* engages transition 80*b*, thereby inhibiting further insertion.

The inner surface(s) of the cup 54*b* includes a first portion 64*b* corresponding to the base 76*b* and a second portion 82*b* corresponding to the annular sidewall 78*b*. In the illustrated embodiment, the reinforcement 56*b* is mounted (e.g., using a brazing material introduced by way of a brazing process) to both the first portion 64*b* and the second portion 82*b*. As mentioned above, the size and placement reinforces the entire cup, effectively doubling its wall thickness.

Figure 9:
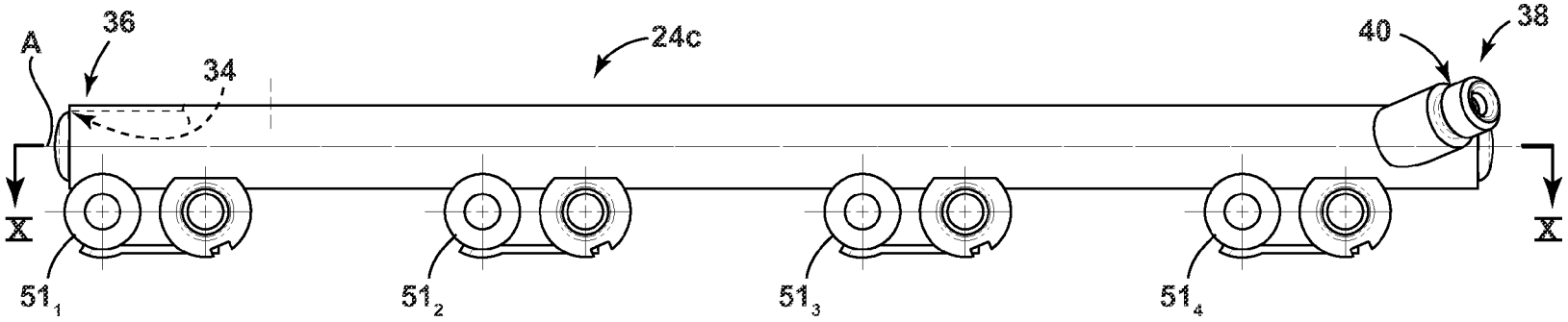
FIG. 9 is a side plan view of a fuel rail assembly including a fourth embodiment of an end cap assembly.
Figure 10:
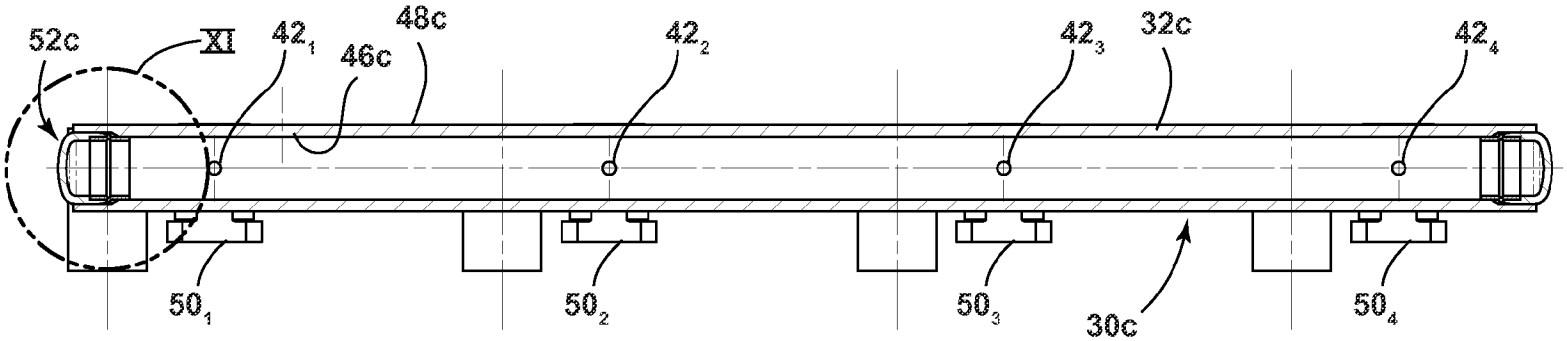
FIG. 10 is a cross-sectional view of the fuel rail assembly of FIG. 9 taken substantially along lines 10-10.
Figure 11:
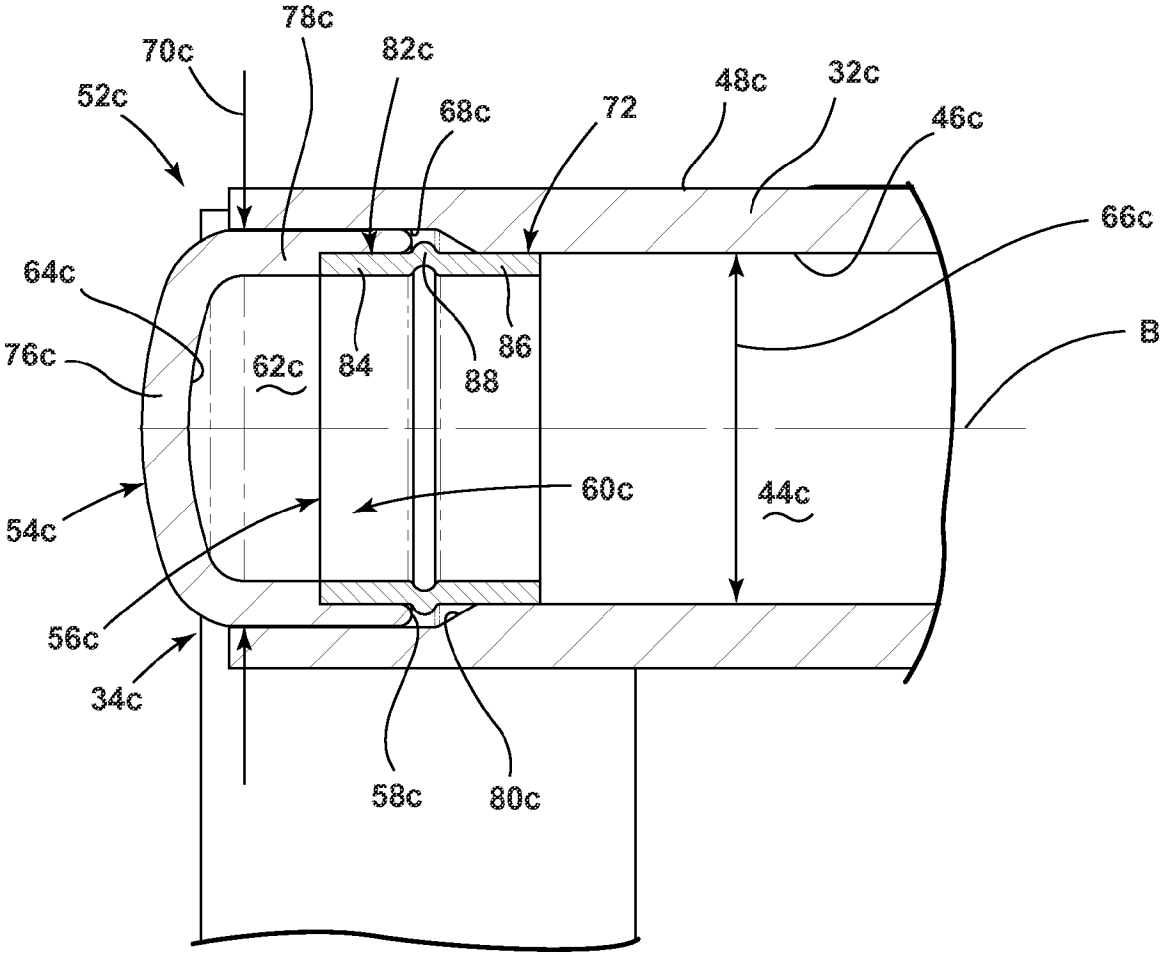
FIG. 11 is an enlarged cross-sectional view of the end cap assembly of FIG. 10.

FIGS. 9-11 illustrate a fuel rail assembly 24*c* that includes a fourth embodiment of an end cap assembly, designated end cap assembly 52*c*. Features and/or components in this embodiments that are similar to the corresponding features and/or components in the previously-described embodiments append a "c" suffix to the pertinent reference numeral. Additionally, the description of the fuel rail assemblies 24, 24*a*, and 24*b* and the end cap assemblies 52, 52*a*, and 52*b* made above applies generally to the fuel rail assembly 24*c* and the end cap assembly 52*c*, with the following additional description(s).

Referring now to FIG. 11, the end cap assembly 52*c* includes a cup 54*c* and an annular reinforcement 56*c*. The cup 54*c* is generally annular and includes a base 76*c* and an annular sidewall 78*c* axially extending away from the base 76*c*. The annular sidewall 78*c* has a free edge 58*c* that defines an aperture 60*c* that leads to an interior 62*c* of the cup 54*c*. The cup 54*c* has inner surfaces 64*c*, 82*c* that face the interior 62*c*.

The outer wall 32*c* has an inside surface 46*c* and an outside surface 48*c*. The inside surface 46*c* in turn includes a first inside diameter portion 66*c* and a second inside diameter portion 70*c*. The second inside diameter portion 70*c* is located proximate to the at least one opening 34*c* and has an inside surface 68*c*. As shown, the first inside diameter portion 66*c* is smaller in diameter than the second inside diameter portion 70*c*, which, in effect, forms a counter-bore 70*c*. In an embodiment, the second inside diameter portion 70*c* can machined to provide a controlled diameter for receiving the end cap assembly 52*c*.

As also shown, the first inside diameter portion 66*c* is relatively distal from both the opening 34*c* and the counter-bore 70*c*. The free edge 58*c* of the cup 54*c* is located proximate to or near a transition 80*c* formed between the first diameter portion 66*c* and the second diameter portion 70*c*. The end cap assembly 52*c* is disposed in the opening 34*c* such that the interior 62*c* of the cup 52*c* faces the interior 44*c* of the fluid conduit 30*c*.

The inner surface(s) of the cup 54*c* includes a first portion 64*c* corresponding to the base 76*c* and a second portion 82*c* corresponding to the annular sidewall 78*c*. In this embodiment, the end cap assembly 52*c* adds the reinforcement 56*c* over the end of the counter-bore—bridging the gap between the cup 54*c* and the inside diameter portion 66*c* of the fluid conduit 30*c*. The annular reinforcement 56*c* thus functions as a coupling member that joins the cup 54*c* to the fluid conduit 30*c*.

In this regard, in the illustrated embodiment, the reinforcement 56*c* is mounted (e.g., using a brazing material introduced by way of a brazing process) to the second portion 82*c* but is not mounted to the first portion 64*c*. Similarly, the reinforcement 56*c* is also mounted to the inside surface 46*c* of the conduit 30*c* at a mounting surface 72 (e.g., using a brazing material introduced by way of a brazing process). In an embodiment, at the end of the second inside diameter portion 70*c* ("counter-bore") between the cup 54*c* and fluid conduit corner (i.e., region 68*c*, 80*c*), brazing material (e.g., a copper preform such as a solid copper ring) can be added for brazing. During the brazing process, liquid copper flows by capillary action into the clearance/gap between the outside of the cup and the inside of the fluid conduit, for example, in region 70*c*. Thus, when the copper preform melts, it leaves a void where the original solid copper ring was initially disposed, namely, at region 68*c*/80*c*. This void can become a relatively high stress area. However, the reinforcement piece 56*c* acts to bridge this void/gap to thereby reinforce this area. In other words, while this gap can be a stress concentration area, the reinforcement 56*c* bridges this gap and reinforces the joint.

With continued reference to FIG. 11, the reinforcement 56*c* comprises a first coupling portion 84 and a second coupling portion 86 separated by an intervening rib 88. Each portion 84, 86, and 88 may extend completely circumferentially. The first coupling portion 84 is mounted (e.g., using a brazing material introduced by way of a brazing process) to inner surface 82*c* of the cup 54*c* and the second coupling portion 86 is mounted (e.g., using a brazing material introduced by way of a brazing process) to the inside surface 46*c* the outer wall 32*c*. As shown, the first and second coupling portions 84, 86 may have a respective outside diameter that is substantially the same.

Additionally, in some embodiments, the transition 80*c* can function as a mechanical stop. In this regard, the rib 88 of the reinforcement 56*c* can be configured in size such that when it is introduced through the end opening 34*c*, the rib 88 engages transition 80*c*, which impedes further insertion. The insertion into opening 34*c* of the reinforcement 56*c* and the cup 54*c* can occur in sequence, or alternatively, the reinforcement 56*c* can be affixed to cup 54*c* to form a sub-assembly, in advance of the insertion of the sub-assembly into the opening 34*c*. After insertion (and application/insertion of appropriate brazing materials), the components can be joined using a brazing material by way of a brazing process, as described above, which brazing process can be the same brazing process that the entire fuel rail assembly is subject to.

Figure 12:
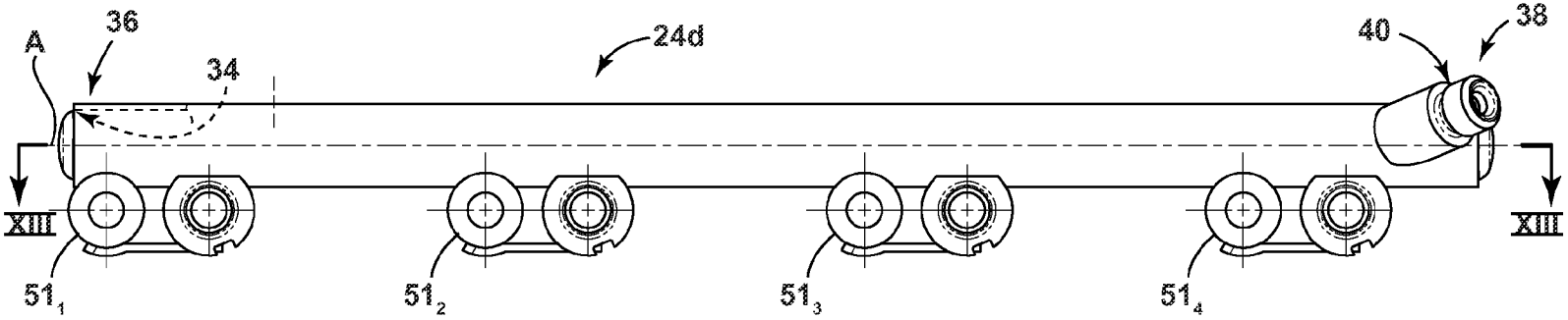
FIG. 12 is a side plan view of a fuel rail assembly including a fifth embodiment of an end cap assembly.
Figure 13:
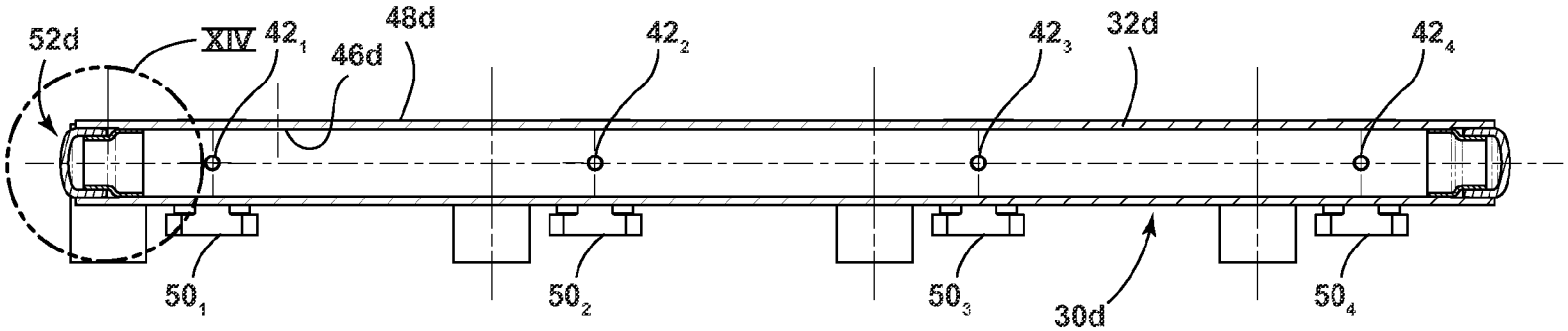
FIG. 13 is a cross-sectional view of the fuel rail assembly of FIG. 12 taken substantially along lines 13-13.
Figure 14:
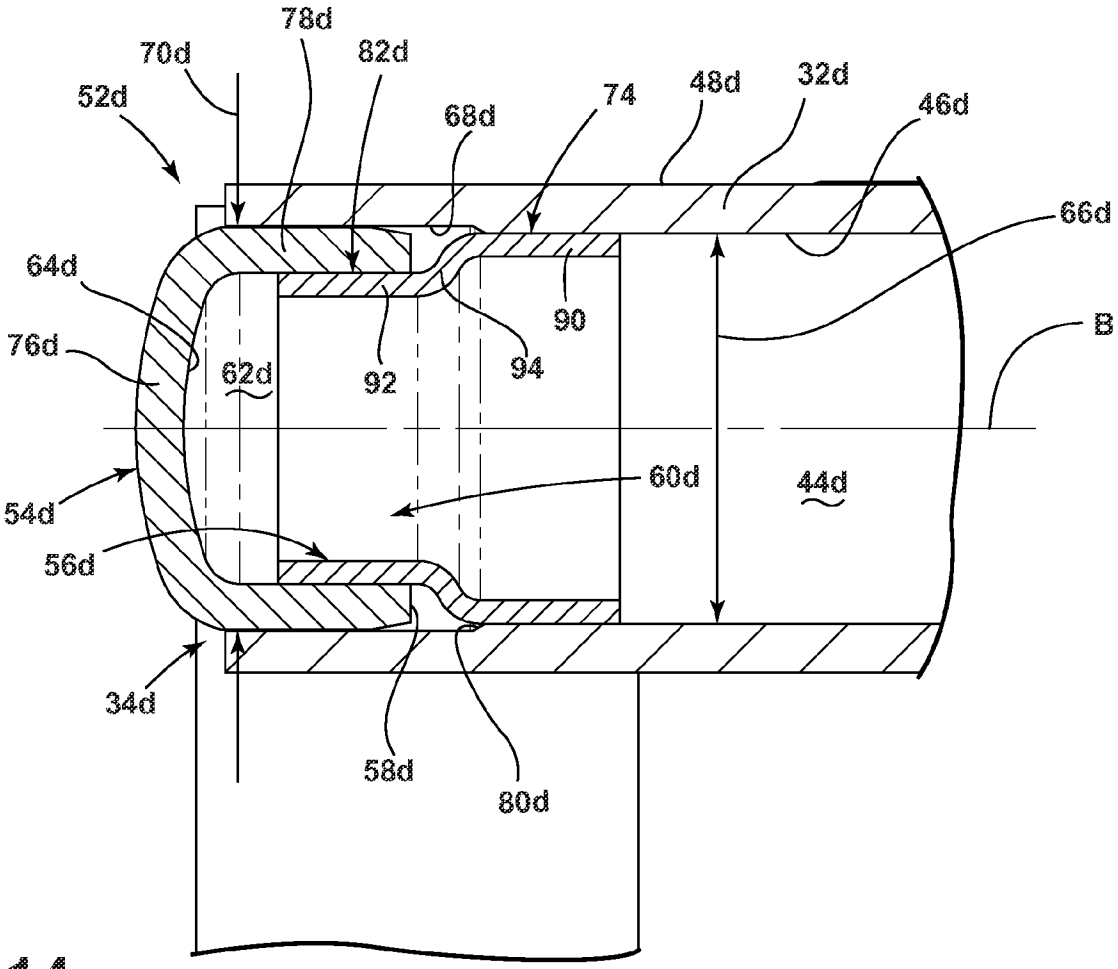
FIG. 14 is an enlarged cross-sectional view of the end cap assembly of FIG. 13.

FIGS. 12-14 illustrate a fuel rail assembly 24*d* that includes a fifth embodiment of an end cap assembly, designated end cap assembly 52*d*. Features and/or components in this embodiments that are similar to the corresponding features and/or components in the previously-described embodiments append a "d" suffix to the pertinent reference numeral. Additionally, the description made above of (i) the fuel rail assemblies 24, 24*a*, 24*b*, and 24*c* and (ii) the end cap assemblies 52, 52*a*, 52*b*, and 52*c*, applies generally to the fuel rail assembly 24*d* and the end cap assembly 52*d*, with the following additional description(s).

Referring now to FIG. 14, the end cap assembly 52*d* includes a cup 54*d* and an annular reinforcement 56*d*. The cup 54*d* is generally annular and includes a base 76*d* and an annular sidewall 78*d* axially extending away from the base 76*d*. The annular sidewall 78*d* has a free edge 58*d* that defines an aperture 60*d* that leads to an interior 62*d* of the cup 54*d*. The cup 54*d* has inner surfaces 64*d*, 82*d* that face the interior 62*d*.

The outer wall 32*d* has an inside surface 46*d* and an outside surface 48*d*. The inside surface 46*d* in turn includes a first inside diameter portion 66*d* and a second inside diameter portion 70*d*. The second inside diameter portion 70*d* is located proximate to the at least one opening 34*d* and has an inside surface 68*d*. As shown, the first inside diameter portion 66*d* is smaller in diameter than the second inside diameter portion 70*d*, which, in effect, forms a counter-bore 70*d*. In an embodiment, the second inside diameter portion 70*d* can machined to provide a controlled diameter for receiving the end cap assembly 52*d*.

As also shown, the first inside diameter portion 66*d* is relatively distal from both the opening 34*d* and the counter-bore 70*d*. The free edge 58*d* of the cup 54*d* is located proximate to a transition 80*d* formed between the first diameter portion 66*d* and the second diameter portion 70*d*. The end cap assembly is disposed in the opening 34*d* such that the interior 62*d* of the cup 52*d* faces the interior 44*d* of the fluid conduit 30*d*.

The inner surface(s) of the cup 54*d* includes a first portion 64*d* corresponding to the base 76*d* and a second portion 82*d* corresponding to the annular sidewall 78*d*. The annular reinforcement 56*d* comprises generally a coupling member that is configured to join the cup 54*d* to the fluid conduit 30*d*. In this regard, in the illustrated embodiment, the reinforcement 56*d* is mounted (e.g., using a brazing material introduced by way of a brazing process) to the second portion 82*d* of the cup but is not mounted to the first portion 64*d* of the cup. Similarly, the reinforcement 56*d* is also mounted to the inside surface 46*d* of the conduit 30*d* at a mounting surface 74 (e.g., using a brazing material introduced by way of a brazing process).

With continued reference to FIG. 11, the reinforcement 56*d* has an enlarged diameter portion 90 having a first outside diameter corresponding to the inside diameter portion 66*d* of the fluid conduit 32*d*. The reinforcement 56*d* further includes a reduced diameter portion 92 having a second outside diameter corresponding to the inside diameter of the annular wall 78*d* of the cup 54*d*. The reinforcement 56*d* also includes a necked-down intermediate region 94 that transitions from the enlarged diameter portion 90 to the reduced diameter portion 92. Each portion 90, 92, 94 may extend completely circumferentially.

Additionally, the outer surface of the cup 54*d* (i.e., the outer surface of the annular sidewall 78d) is mounted to inside surface 68*d*, for example, using a brazing material by way of a brazing process. For example, after insertion of reinforcement 56*d* and cup 54*d* (and application/insertion of appropriate brazing materials), the components can all be joined using the brazing material by way of a brazing process, which brazing process can be the same brazing process that the entire fuel rail assembly is subject to.

It should be understood that the terms "top", "bottom", "up", "down", and the like are for convenience of description only and are not intended to be limiting in nature.

While one or more particular embodiments have been shown and described, it will be understood by those of skill in the art that various changes and modifications can be made without departing from the spirit and scope of the present teachings.

What is claimed is:

1. A fuel rail assembly, comprising:

a fluid conduit extending along a first longitudinal axis and having a body portion with inside and outside surfaces, said conduit having an opening at one of first and second longitudinal ends thereof, said fluid conduit further having an inlet configured to be coupled to a high-pressure fuel pump, at least one outlet, and a conduit interior forming a fluid flow passageway between said inlet and said at least one outlet configured to allow for fluid communication therebetween;

an end cap assembly mounted to said fluid conduit and configured to cover and close said opening, said end cap assembly including:

a cup having a free edge that defines an aperture that leads to a cup interior, said cup having an inner surface facing said cup interior; and a reinforcement mounted to said inner surface of said cup.

2. The fuel rail assembly of claim 1 wherein said cup includes a base and an annular sidewall axially extending away from said base in a first direction, said annular sidewall having said free edge.

3. The fuel rail assembly of claim 2 wherein said body portion comprises an outer wall having said inside and outside surfaces wherein said inside surface a first inside diameter portion and a second inside diameter portion that is located proximate said at least one opening of said fluid conduit, said second inside diameter portion being smaller than said first inside diameter portion, said first inside diameter portion is located distal of both said opening and said second inside diameter portion, said free edge of said cup being located proximate a transition between said first diameter portion and said second diameter portion.

4. The fuel rail assembly of claim 3 wherein said inner surface of said cup includes a first portion corresponding to said base and a second portion corresponding to said annular sidewall, wherein said reinforcement is mounted to said first portion and not to mounted to said second portion.

5. The fuel rail assembly of claim 3 wherein said inner surface of said cup includes a first portion corresponding to said base and a second portion corresponding to said annular sidewall, wherein said reinforcement is mounted to said first portion and to said second portion.

6. The fuel rail assembly of claim 3 wherein said inner surface of said cup includes a first portion corresponding to said base and a second portion corresponding to said annular sidewall, wherein said reinforcement is mounted to said second portion and not to said first portion.

7. The fuel rail of assembly of claim 6 wherein said reinforcement comprises first and second coupling portions separated by an intervening rib, wherein said first coupling portion is mounted to an inside of said annular sidewall of said cup and said second coupling portion is mounted to said first inside diameter portion of said conduit.

8. The fuel rail assembly of claim 7 wherein said first and second coupling portions have equal outside diameters.

9. The fuel rail assembly of claim 6 wherein said reinforcement comprises an enlarged diameter portion having a first outside diameter corresponding to said first inside diameter portion of said fluid conduit, said reinforcement further including a reduced diameter portion having a second outside diameter corresponding to an inside diameter of said annular wall of said cup.

10. The fuel rail assembly of claim 9 wherein reinforcement further includes an intermediate section between said enlarged diameter portion and said reduced diameter portion.

11. The fuel rail assembly of claim 9 wherein said annular sidewall of said cup is mounted to said first diameter portion of said fluid conduit, said reduced diameter portion of said reinforcement is mounted to an inside of said annular sidewall of said cup, said enlarged diameter portion being mounted to said first diameter portion of said fluid conduit.

12. The fuel rail assembly of claim 1 wherein said end cap assembly extends along a second longitudinal axis, wherein said first and second longitudinal axes are substantially coincident, and wherein said base of said cup is disposed generally transverse with respect to said first and second longitudinal axes.

13. The fuel rail assembly of claim 1 wherein said end cap assembly is mounted to said conduit so that said cup interior faces said fluid conduit interior.

14. The fuel rail assembly of claim 1 wherein said reinforcement is mounted to said cup with a brazing material.

15. The fuel rail assembly of claim 1 wherein said end cap assembly is mounted to said conduit with a brazing material.

16. The fuel rail assembly of claim 14 wherein said brazing material comprises a copper alloy.

* * * * *